US005090625A

United States Patent [19]

Davis

[11] Patent Number: 5,090,625

[45] Date of Patent: Feb. 25, 1992

[54] NOZZLES FOR IN-CYLINDER FUEL INJECTION SYSTEMS

[75] Inventor: Robert M. Davis, Maylands, Australia

[73] Assignee: Orbital Engine Company Proprietary Limited, Balcatta, Australia

[21] Appl. No.: 362,986

[22] Filed: Jun. 8, 1989

[30] Foreign Application Priority Data

Jun. 10, 1988 [AU] Australia ..... PI8742

[51] Int. Cl.[5] ..... B05B 1/32

[52] U.S. Cl. ..... 239/453; 239/533.12

[58] Field of Search ..... 239/452, 453, 533.12

[56] References Cited

U.S. PATENT DOCUMENTS

| | | | |
|---|---|---|---|
| 1,737,155 | 11/1929 | Hewitt | 239/452 |
| 1,826,977 | 10/1931 | Baker | 239/452 |
| 1,934,580 | 11/1933 | Woolson | 239/453 X |
| 2,035,265 | 3/1936 | Edwards | 239/453 |
| 2,433,985 | 1/1948 | Fodor | 239/453 |
| 2,602,005 | 7/1952 | Weldy | 239/453 |
| 2,612,408 | 9/1952 | Kurata | 239/453 X |
| 3,728,859 | 4/1973 | Seiler | 239/453 X |
| 4,408,722 | 10/1983 | Frelund | 239/533.12 X |
| 4,572,436 | 2/1986 | Stettner et al. | 239/585 B |
| 4,588,132 | 5/1986 | Neitz et al. | 239/453 |
| 4,621,772 | 11/1986 | Blythe et al. | 239/585 C |
| 4,705,210 | 11/1987 | Graser et al. | 239/585 B |
| 4,759,335 | 7/1988 | Ragg et al. | 123/531 |

FOREIGN PATENT DOCUMENTS

| | | |
|---|---|---|
| 1076184 | 7/1967 | United Kingdom . |
| 1219938 | 1/1971 | United Kingdom . |
| 2029508 | 3/1980 | United Kingdom . |

*Primary Examiner*—Andres Kashnikow
*Assistant Examiner*—Kevin P. Weldon
*Attorney, Agent, or Firm*—Armstrong, Nikaido, Marmelstein, Kubovcik and Murray

[57] ABSTRACT

An internal combustion engine in-cylinder fuel injector nozzle having a body having a fuel passage terminating in a port that, in use, communicates the fuel passage with an engine combustion chamber. The port has an annular seat therein and a valve element also having an annular seat co-operates with the seat in the port to control fuel flow therethrough. An annular flow directing surface extends downstream from each of the annular seats, and each flow directing surface is contoured to blend smoothly with its respective seat.

13 Claims, 3 Drawing Sheets

NOZZLES FOR IN-CYLINDER FUEL INJECTION SYSTEMS

This invention relates to the injecting of fuel into the combustion chamber of an internal combustion engine through a valve controlled nozzle.

The characteristics of the spray of the fuel droplets issuing from a nozzle into a combustion chamber have major effects on the efficiency of the burning of the fuel, which in turn affects the stability of the operation of the engine, the engine fuel consumption and the composition of the engine exhaust gases. To optimise these effects, particularly in a spark ignited engine, the desirable characteristics of the spray pattern of the fuel issuing from the nozzle include small fuel droplet size, controlled penetration of the fuel spray into the chamber, and at least at low engine loads, a relatively contained and ignitable cloud of fuel droplets in the vicinity of the spark plug.

Some known injector nozzles, used for the delivery of fuel directly into the combustion chamber of an engine, are of the poppet valve type, from which the fuel issues in the form of a divergent conical spray.

The nature of the shape of the fuel spray is dependent on a number of factors including the geometry of the port and valve constituting the nozzle, especially the geometry of those surfaces of the port and valve immediately downstream of the seat where the port and valve engage to seal when the nozzle is closed. Once a nozzle geometry has been selected to give the required performance, relatively minor departures from that geometry can significantly impair the performance thereof. In particular the attachment or build-up of solid combustion products or other deposits on surfaces over which the fuel flows can be detrimental to the correct performance of the nozzle.

It is therefore an object of the present invention to provide a nozzle, through which fuel can be injected into a combustion chamber of an engine, that will contribute to a reduction in the build up of deposits in the path of fuel being delivered to the combustion chamber.

With this object in view there is provided an internal combustion engine in-cylinder fuel injector nozzle comprising a body having a fuel passage and a body end portion with a terminal face, a port in the body end portion to, in use, communicate the fuel passage with the engine combustion chamber, said port having an annular seat therein, a valve element having an annular seat to co-operate with annular seat in said port to control flow therethrough, and an annular flow directing surface in the port extending downstream from the seat therein to said terminal face, characterised in that said flow directing surface is contoured to blend smoothly with the seat in the port and the valve element having a flow directing surface opposed to the flow directing surface in the port, and contoured to blend smoothly with the valve seat.

The terminal face of the body is conveniently shaped to form a transverse annular land at the junction with the flow directing surface of the port and preferably flairs outwardly and backwardly from the land.

The terminal face in the area of junction with the flow directing surface intersects the flow directing surface substantially at right angles thereto.

If a land is provided forming part of the terminal face of the body the radial width thereof may be of the order of up to 0.25 mm or in the range 0.06 to 0.25 mm, preferably of the order of 0.15 mm. Preferably when the valve element is in a position that the port is open, the terminal edges of each flow directing surface are substantially co-planar.

The terminal face of the body immediately outward of annular land may be recessed or stepped back from the plane of the land. The terminal face of the body outwardly of the land may be generally in a plane parallel to but offset backwardly from the land with a radius or flared portion forming a concave junction between the land and the remainder of the terminal face of the body.

The terminal face of the body may alternatively be of a shallow truncated conical form tapering outwardly and backwardly from the junction of the flow directing surface of the port with the terminal face of the body. Preferably the angle of the cone is such that the terminal face is substantially at right angles to the port fuel directing face at the junction thereof. The included angle of the cone may conveniently be up to 180°, preferably in the range of 140° to 160°. A small land, normally of the order of 0.1 mm in width, can be provided to remove the edge which would otherwise be established by the junction of the truncated conical terminal face and the flow directing surface of the port.

The provision of a smooth transition from the port seat to the flow directing surface contributes to the maintenance of attachment of the fuel to the flow directing surface as the fuel is passed to the combustion chamber as separation therebetween can be conducive to the formation of carbon build up in the area not in contact with the passing fuel. Conveniently the flow directing surface in the port includes a radiused portion that blends smoothly with the valve seat and with the remainder of the port flow directing surface which may conveniently be of a truncated conical shape.

Conveniently, the flow directing surface on the valve element also blends smoothly with the seat surface on the valve element so as to also promote the retention of contact of the flow with the flow directing surface of the valve element and contribute to the reduction in potential carbon build up on the valve element.

The fuel injector nozzle as above disclosed is particularly advantageous for use in a fuel injection system wherein a liquid fuel is delivered to the combustion chamber entrained in a gas such as air. The maintaining of the contact with the flow directing surface is of particular importance in controlling the spray pattern of a two-fluid mixture issuing from an injector nozzle.

Further as an aid in maintaining contact between the fuel and the flow directing surfaces on both the port and the valve element it is preferable, when the valve element is in the open position, for the extremities of the flow directing surfaces to each be in a common plane so that neither flow directing surface projects beyond the other in the direction of flow of the fuel. In the event that one of the flow directing surfaces extends beyond the other there is a tendency for the fuel to move away from the extending surface, particularly with two fluid or a gaseous fuel, due to the expansion that can take place, once the fuel moves clear of the one flow directing surface thus creating a reduced velocity along the longer extending flow directing surface and thereby potentially promoting the accumulation of deposits thereon and influencing the geometry of the spray.

The invention will be more readily understood from the following description of two practical arrangements of the fuel injector nozzle as depicted in the accompanying drawings.

Figure 1:
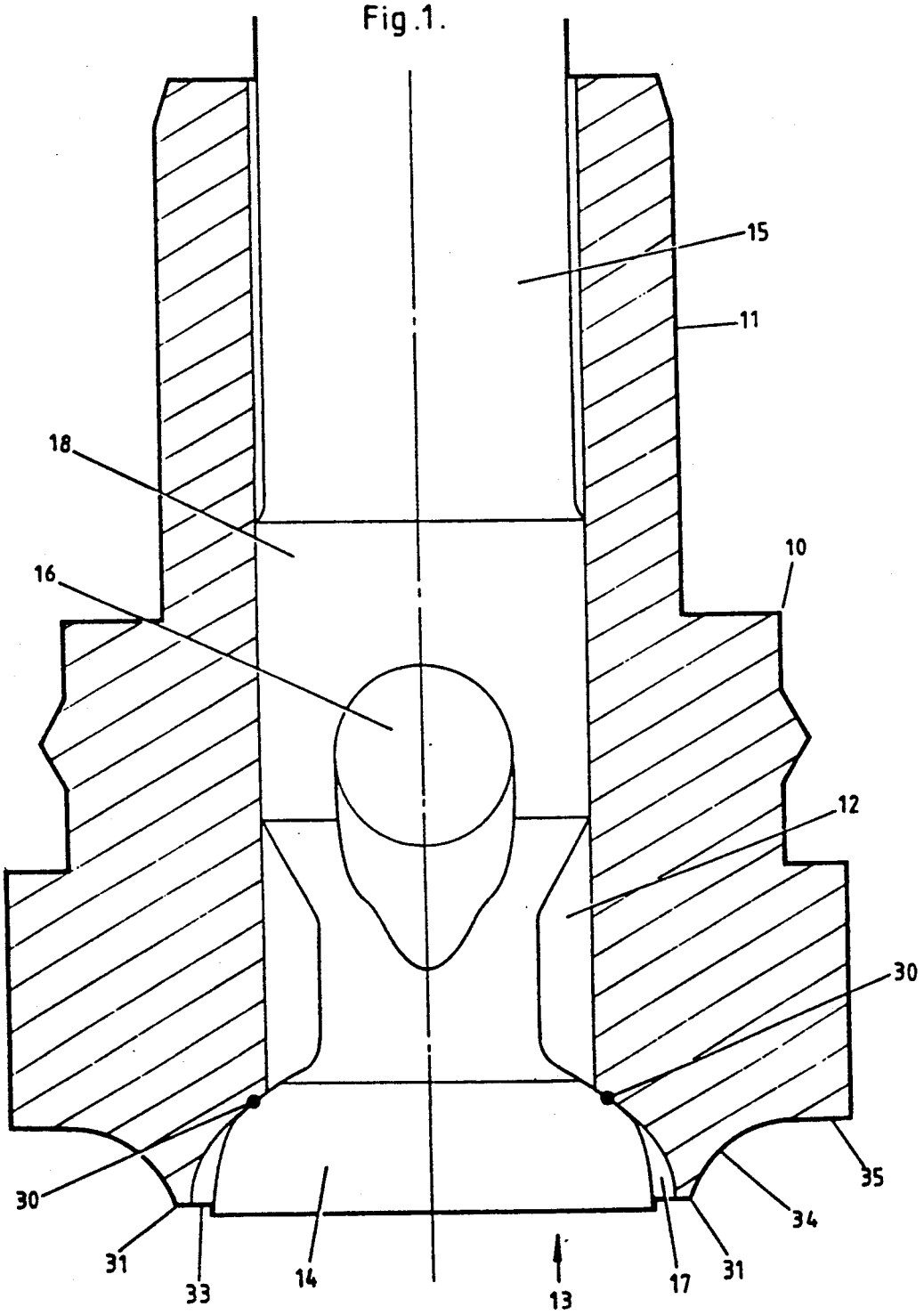
FIG. 1 is a sectional view of the nozzle portion of a fuel injector.
Figure 2:
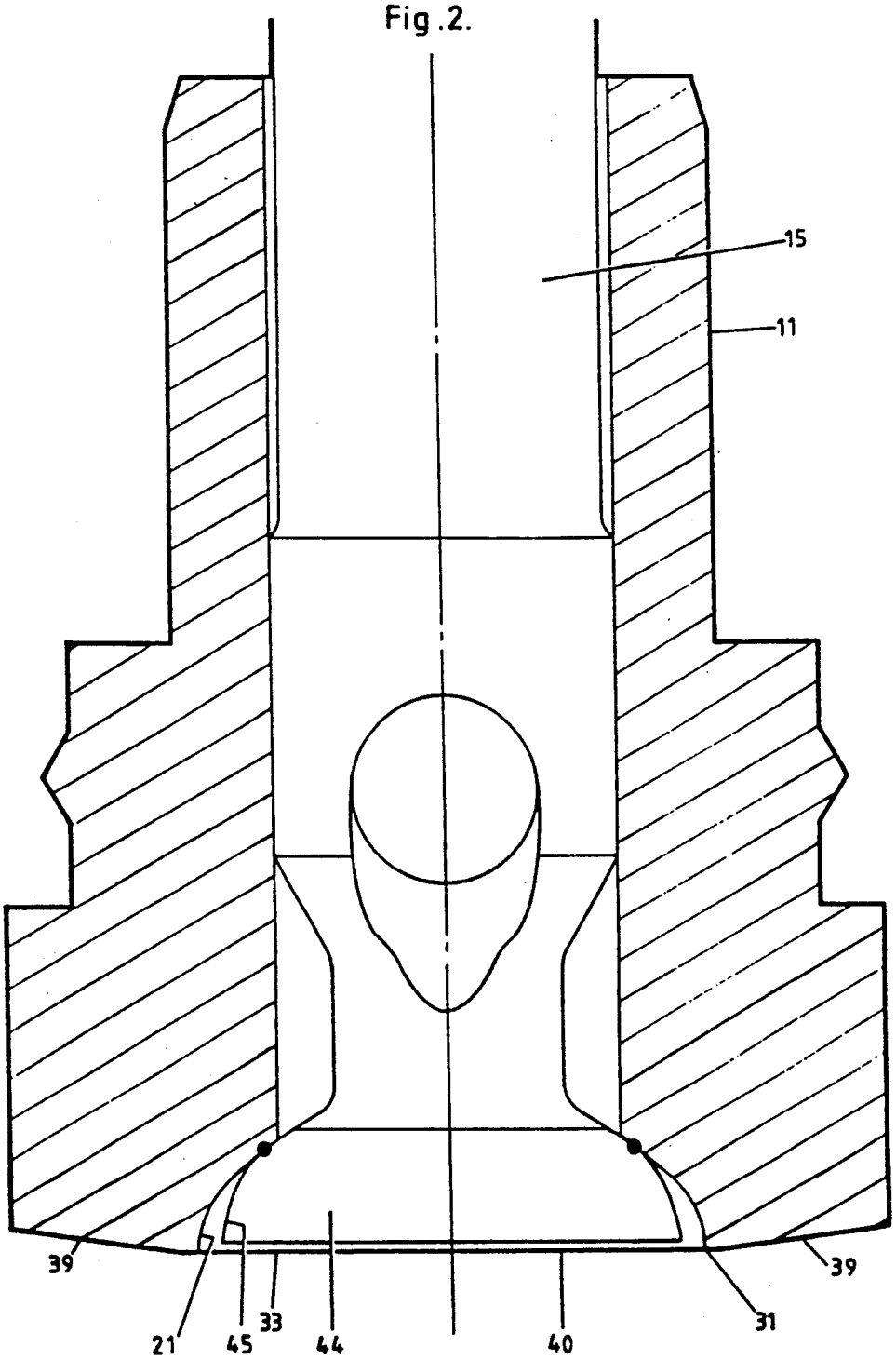
FIG. 2 is a sectional view similar to FIG. 1 of an alternative form of fuel injector nozzle.

The fuel injector nozzles as depicted in FIGS. 1 and 2 and hereinafter described maybe incorporated into a wide range of fuel injectors as used for delivering fuel directly into the combustion chamber of an engine. Typical forms of injectors in which the nozzle in accordance with the present invention may be incorporated are disclosed in West German patent application No. 3808671.9 and International patent application No. PCT/AU88/00096 each in the name of Orbital Engine Company Pty Ltd and the disclosure in each of these prior applications is hereby incorporated in the specification by reference.

Referring now to FIG. 1 of the drawings, the body of the fuel injector nozzle 10 is of a generally cylindrical shape having a spigot portion 11 which is provided to be received in a bore provided in a co-operating portion of the complete fuel injector unit. The valve 13 has a valve head 14 and a valve stem 15. The stem 15 has a guide portion 18 which is axially slidable in the bore 12 of the body 10. The stem 15 is hollow so that the fuel may pass therethrough and openings 16 are provided in the wall of the stem 15 to permit the fuel to pass from the interior of the stem 15 into the bore 12.

The valve head 14 is received in the port 17 provided in the end of the body 10 and which communicates with the bore 12. As seen in greater detail in FIG. 3, the wall of the port 17 is formed by an inner conical portion 20 having an included angle of 90° and an outer conical portion 21 having an included angle of between 0° to 60°, conveniently 20° to 60°, and an arcuate portion 22 forming a smooth blend between the respective conical portions 20, 21.

Figure 4:
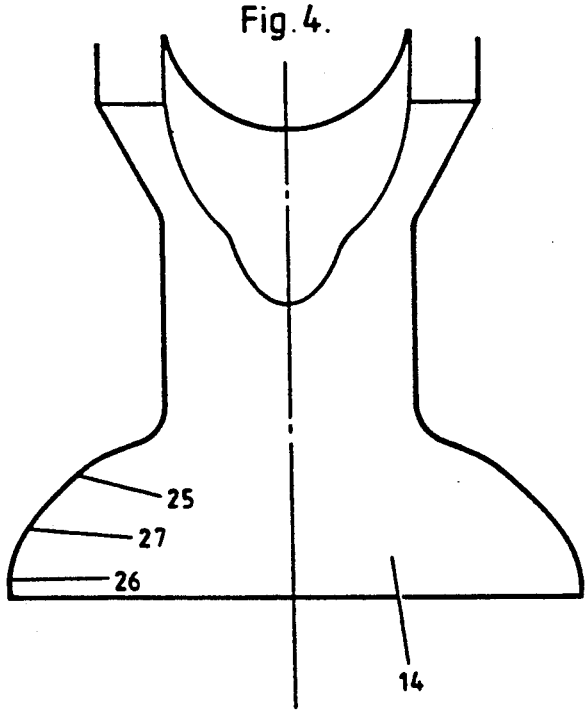
FIG. 4 is an enlarged view of the valve head area of the nozzle valve of FIG. 1.

Referring to FIG. 4 the head 14 of the valve has an external surface formed by an inner arcuate proportion 25, an outer conical portion 26 having an included angle of up to 60°, conveniently 0° to 40°, and a small arcuate portion 27 forming a smooth blend between the inner arcuate portion 25 and the outer conical portion 26. The inner arcuate portion 25 of the valve head co-operates with the inner conical portion 20 of the port to provide the required seal between the valve head and the port when the valve is in the closed position. The provision of mating conical and arcuate surfaces facilitates manufacture and ensures an effective seal is established between the port and the valve head. The designed line of contact between the valve head and the port is indicated by the dots 30 in FIG. 1.

As can be seen in FIG. 1 a relatively narrow land 31 is provided around the peripheral edge of the port 17 where the conical surface 21 of the port intersects the terminal end face 33 of the body. The land 31 may have a width of the order of 0.16 to 0.25 mm. Outwardly of the land 31 the terminal face of the body is swept back in an arcuate form as indicated at 34 to merge with a generally radial portion 35 adjacent the outer surface of the body 10.

Figure 3:
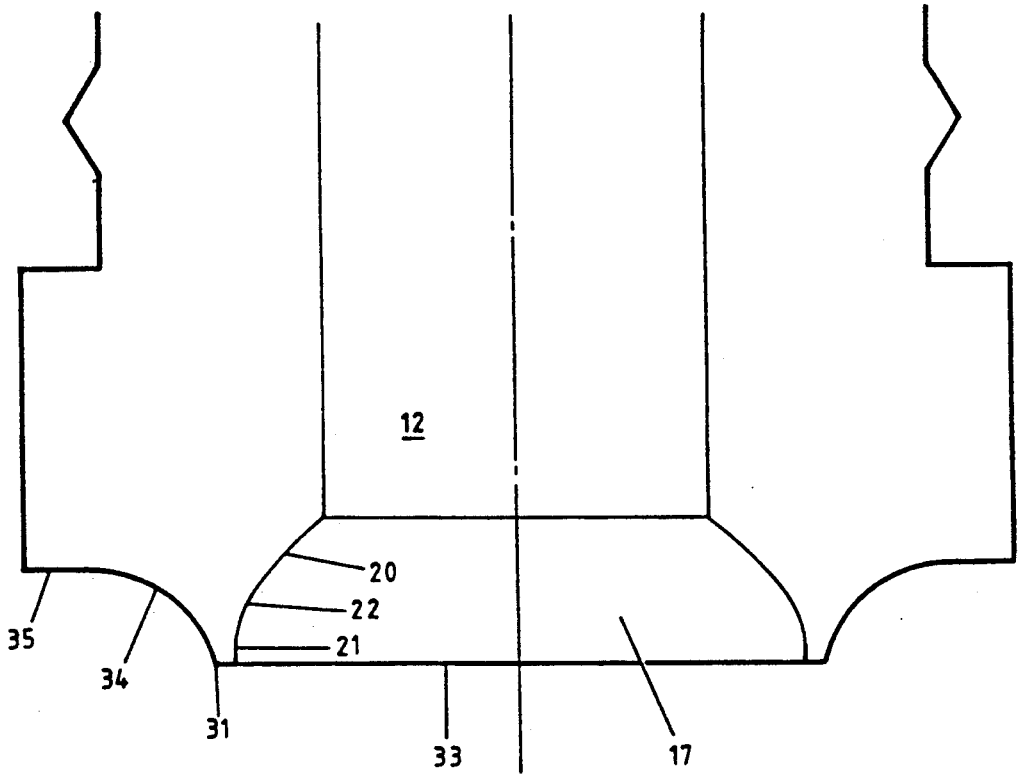
FIG. 3 is an enlarged view of port area of the nozzle body of FIG. 1.

It can be seen from FIGS. 1 and 3 that the land 31 is exposed to the high temperature gases in the engine combustion chamber, and is of a relatively small cross sectional area. As a consequence, the land 31 will generally be raised to a substantially higher temperature than the remainder of the body 10 which is exposed to the high temperature gases through the surfaces 34 and 35. This higher operating temperature of the land 31 will promote the burning of any particles that may deposit thereon, thus mitigating against the build up of deposits on the land portion and on the outer conical portion 21 of the port. The establishing of the high temperatures as above referred to is particularly relevant in an engine which has a high operating temperature, such as an air cooled engine.

Further, the smooth contour of the internal surface of the port 17 and the external surface of the valve head 14, as previously described, will promote the maintenance of fuel contact with these surfaces during the delivery of fuel through the port. The maintenance of this contact further contributes to the avoidance of carbon build up on these surfaces as the fuel flow has a scouring action on the surfaces over which it flows, particularly having regard to the high speed of the fuel. This scouring action also inhibits the formation of gum deposits from the fuel on the relevant surfaces. These gum deposits are believed to contribute to the promotion of carbon build up.

The valve head 14 as depicted in FIG. 1 projects slightly beyond the terminal surface 32 when in the closed position. Upon displacing the valve head downwardly, as seen in FIG. 1 to open the port 17 the end face 40 of the valve head 14 will be further displaced from the terminal end face 33 of the body. This can promote separation of the fuel from the projecting part of the outer conical portion 26 of the valve head 14, as the fuel is delivered through the port, thereby promoting the depositing of gum and carbon particles onto the exposed part of the surface of the valve head 14.

In order to reduce this problem, particularly for two fluid injector nozzles, the valve head 44, as shown in FIG. 2, is of an axial length so that when the valve is in the open position the extremity of the end face 40 of the valve head 44 is substantially co-planar with the terminal face 33 of the body. This relationship assisting in maintaining contact of the fuel being delivered with both the outer conical portions 21 and 26 of the body and valve head respectively.

As the majority of the components and features of the nozzle construction as shown in FIG. 2 are the same as shown in FIG. 1, the description of the construction shown in FIG. 2 will be restricted to the differences, and the uncharged components and features retain the same reference numerals.

Also as seen in FIG. 2 of the drawings that part of the terminal face of the body extending outwardly from the land 31 is of a flat truncated conical form as indicated at 39 in contrast to the deep arcuate configuration as shown in FIG. 1. This truncated conical portion 39 of the terminal face of the body has an included angle selected so that the conical surface is substantially normal to the outer conical surface 21 of the port 17. This configuration results in the fuel flow issuing from the port 17 being substantially at right angles to the surface of the conical portion 39 and so strikes at right angles any carbon build up that may tend to project into the fuel stream, to provide the maximum force for breaking off or clearing away any carbon build up which tends to extend into the path of the fuel issuing from the port.

The nozzle as shown in FIG. 2 is preferred to low temperature operating engines, such as water cooled engines. The reduced area of the face 39 compared with faces 34 and 35 combined reduces the temperature of the nozzle body where exposed to the engine combustion chamber.

I claim:

1. An internal combustion engine in-cylinder fuel injector nozzle comprising a body having a fuel passage extending to a terminal face at one end thereof, a port in the body end portion to, in use, communicate the fuel passage with the engine combustion chamber, said port having an annular seat therein, a valve element mounted for movement between an open position and a closed position, said valve element having an annular seat to co-operate with said annular seat in the port to control fuel flow therethrough when said valve element is moved to said open position and to contact said annular seat in the port when said valve element is moved to said closed position, and a respective annular flow directing surface extending downstream from each of the annular seats, said flow directing surfaces each diverging outwardly from the respective seats and respectively being contoured to blend smoothly with the respective seats.

2. A fuel injector nozzle as claimed in claim 1, wherein said terminal face of said body end portion is downstream of the port annular seat and shaped to form a transverse annular land at a junction of said terminal face with the flow directing surface of the port.

3. A fuel injector nozzle as claimed in claim 2, wherein said terminal face flares outwardly and backwardly from the outer edge of said annular land.

4. A fuel injector nozzle as claimed in claim 2 or 3, wherein the terminal face intersects the flow directing surface of the port substantially at right angles.

5. A fuel injector nozzle as claim 2 or 3 wherein the land has a width of about 0.06 to 0.25 mm.

6. A fuel injector nozzle as claimed in claim 2, wherein the terminal face intersects the flow directing surface of the port substantially at right angles and the land has a width of about 0.06 to 0.25 mm.

7. A fuel injector nozzle as claimed in any one of claims 1, 2, 3 or 6, wherein said valve element and port seats are located so that when the valve element is in the open position the extremities of each of the flow directing surfaces are substantially co-planar.

8. A fuel injector nozzle as claimed in claim 2 or 3 wherein the terminal face of the body is substantially conical with an included angle of up to 180° with a land at the junction of the terminal face and the flow directing surface of the port of a width about 0.01 mm.

9. A fuel injector nozzle as claimed in claim 8, wherein said included angle is between 140° and 160°.

10. A fuel injector nozzle as claimed in claim 5 wherein the terminal face of the body is substantially conical with an included angle of up to 180° with a land at the junction of the terminal face and the flow directing surface of the port of a width about 0.1 mm.

11. A fuel injector nozzle as claimed in claim 10, wherein said included angle is between 140° and 160°.

12. A fuel injector nozzle as claimed in claim 7, wherein the terminal face of the body is substantially conical with an included angle of up to 180° with a land at the junction of the terminal face and the flow directing surface of the port of a width of about 0.1 mm.

13. A fuel injector nozzle as claimed in claim 12, wherein said included angle is between 140° and 160°.

* * * * *